United States Patent [19]

Hiraga

[11] 4,008,005

[45] Feb. 15, 1977

[54] REFRIGERANT COMPRESSOR

[75] Inventor: Masaharu Hiraga, Isesaki, Japan

[73] Assignee: Sankyo Electric Company, Limited, Isesaki, Japan

[22] Filed: July 29, 1975

[21] Appl. No.: 599,973

[30] Foreign Application Priority Data

| | | |
|---|---|---|
| July 31, 1974 | Japan | 49-88858 |
| July 31, 1974 | Japan | 49-88859 |
| July 31, 1974 | Japan | 49-88860 |

[52] U.S. Cl. ..... 417/269; 74/591

[51] Int. Cl.[2] ..... F04B 1/12

[58] Field of Search ..... 417/269, 270; 74/589-591

[56] References Cited

UNITED STATES PATENTS

| | | | |
|---|---|---|---|
| 2,182,740 | 12/1939 | Wrigley | 74/591 |
| 2,699,502 | 1/1955 | Hohl et al. | 74/591 |
| 3,306,230 | 2/1967 | Raymond | 417/270 |
| 3,552,886 | 1/1971 | Olson, Jr. | 417/269 |

*Primary Examiner*—William L. Freeh

*Attorney, Agent, or Firm*—Hopgood, Calimafde, Kalil, Blaustein & Lieberman

[57] ABSTRACT

A refrigerant compressor having pistons reciprocated in respective cylinders through piston rods by a wobble plate driven by a wedge-shaped rotor which is secured on a drive shaft, which compressor has a structure which is dynamically balanced so that reduced vibration of the compressor may occur in the operation thereof. The wobble plate and the wedge-shaped rotor are, respectively and/or in combination, so formed that all of the centrifugal forces developed on the plate and the rotor cancel out one another in radial directions, and the torques on the wobble plate and the rotor developed due to the centrifugal forces cancel torques provided on the wobble plate due to inertia of the wobble plate, pistons and piston rods which are reciprocated.

7 Claims, 10 Drawing Figures

REFRIGERANT COMPRESSOR

BACKGROUND OF THE INVENTION

This invention relates to fluid suction and discharge apparatus which are used for such as refrigerant compressors, and, more particularly, to improvements of such apparatus of a type in which pistons are reciprocated in respective cylinders by a wobble plate driven by a wedge-shaped rotor which is secured on a drive shaft.

Such a fluid suction and discharge apparatus having pistons reciprocated by means of a wobble plate and wedge-shaped rotor, are known as described, for example, by the refrigerant compressors disclosed in U.S. Pat. Nos. 3,552,886 (which is reissued under No. 27,844), 3,761,202 and 3,838,942. The fluid suction and discharge apparatus is little in volume and is suitable for refrigeration systems of the automotive or mobile type.

One problem in such a fluid suction and discharge apparatus is that vibration develops in greater degree than in apparatus of the other types.

Vibration of the apparatus is transmitted to any device (for example, a motor of a vehicle, the body of a car or other) on which the apparatus is mounted through mounting members so that bolts used in the apparatus and the device may be loosened, and the used parts may be damaged and their life times shortened.

The main reason why the fluid suction and discharge apparatus of this type develops vibration to a greater degree is thought to be that the wedge-shaped rotor is asymmetric about the rotating central axis thereof, and that, in operation, various motions of parts thereof are carried out. But the reason has not yet been fully resolved.

Even if the wedge-shaped rotor is formed hollow so that the centroid thereof may be on the rotating axis thereof as shown in the drawing annexed to above described U.S. Pat. No. 3,552,886, a considerable vibration still develops during the operation, although vibration is reduced to a certain degree.

If a system of the rotor, wobble plate, piston rods and pistons is so formed that a centroid of the system may be on the rotating axis of the drive shaft, vibration is more reduced, but the reduction of vibration is not yet satisfied.

The present inventor dynamically analyzed the system of the rotor, wobble plate, piston rods, and pistons (which system will be referred as "the operation system") and obtained the following conclusion;

1. If the centroid of the operation system is on the rotating axis, a centrifugal force uniformly develops around the rotating axis in the operation system so that no unbalanced radial force may exist. Accordingly, the radial vibration of the system does not occur.

2. During reciprocating motion of the pistons and piston rods, axial forces due to inertia thereof develop. But the sum total of the axial forces may be zero if all of the pistons and piston rods are equal angularly spaced around the rotating axis and if all the pistons and piston rods are equal to one another in mass. In this case, the system is not axially vibrated.

3. But the axial forces due to the inertia of the pistons and piston rods apply on different points on the wobble plate, and, therefore, provide a torque to the wobble plate on an axis perpendicular to the rotating axis.

Thus, the operation system is vibrated by this torque.

4. If the rotor is not so formed that the mass distribution thereof is symmetrical in relation to the rotating axis, a torque develops due to centrifugal forces during the rotation of the rotor, which rotates the rotor on an axis perpendicular to the rotating axis.

Accordingly, for the reduction of vibration of a fluid suction and discharge apparatus of a type in which a wedge-shaped rotor and a wobble plate are used for the reciprocating motions of a plurality of pistons and piston rods, torques as described in paragraphs numbered 3 and 4 are necessary to be suppressed. In addition, the operation system is so formed that the centroid thereof may be on the rotating axis.

SUMMARY OF THE INVENTION

A general object of this invention is to provide a fluid suction and discharge apparatus of a type in which a wedge-shaped rotor and a wobble plate are used for the reciprocating motions of a plurality of pistons and piston rods, in which the vibration of the apparatus is reduced during the operation.

Another object of this invention is to provide a fluid suction and discharge apparatus of a type in which a plurality of pistons are reciprocated at different phases of the reciprocating motion from one another through piston rods by the wobbling motion of a wobble plate driven by a wedge-shaped rotor fixed on a drive shaft, which apparatus is characterized in that the operation system of the rotor, the wobble plate, pistons and piston rods, is so arranged that the centroid thereof is on a central axis of the drive shaft and a torque is developed in the system during the operation of the apparatus, which torque cancels the torque due to the inertia of the pistons and piston rods, whereby a considerably reduced vibration is developed in the apparatus during the operation thereof.

A further object of this invention is to provide such an apparatus with a simple structure to realize the above objects.

Another object of this invention is to realize the above objects by a control of centroids and unbalance of the wobble plate and rotors in such an apparatus.

According to an aspect of this invention, there is obtained a fluid suction and discharge apparatus having a wedge-shaped rotor, a wobble plate, and a plurality of pistons and piston rods in which the wobble plate is so formed that a centroid thereof is on a wobbling center thereof, all of the pistons and piston rods being equal to each other in mass and being equal-angularly spaced about a central axis of the rotor, and the rotor being so formed that the centroid is on the central axis thereof, whereby a centroid of the system of the rotor, the wobble plate pistons, and piston rods is on the central axis of the rotor. Further, the rotor is so formed that centroids of two half sections of the rotor split by an imaginary plane are axially spaced by a predetermined distance, which imaginary plane includes the central axis and is perpendicular to another plane defined by the central axis and a point on an inclined surface of the wedge-shaped rotor which point is nearest to a cylinder block including cylinder bores for the pistons. The axial distance is so determined that a torque due to centrifugal forces developed by the rotor during the rotation of the rotor may cancel a torque due to inertia of the pistons, piston rods, and wobble plate during the reciprocation thereof.

In an apparatus according to another aspect of this invention, the wobble plate is so formed that the centroid thereof may be on a perpendicular drawn from the wobbling center to the inclined surface of the rotor. The rotor is provided with an unbalanced weight at an angular position thereof angularly spaced from the angular position of the centroid of the wobble plate about the central axis of the rotor. The unbalance weight is so defined that a centrifugal force developed by the rotation of the centroid of the wobble plate about the central axis of the rotor may be cancelled with a centrifugal force due to said unbalanced weight during the rotation of the rotor, whereby the balance of the system may be maintained. These two centrifugal forces provide a torque which partially cancels the torque due to the inertia of the pistons, piston rods, and wobble plate. Therefore, the predetermined axial distance between the centroids of the two half sections thereof is determined to develop a torque due to centrifugal forces during the rotation of the rotor which may cancel the balance of the torque due to the inertia of the pistons, piston rods, and wobble plate.

Further objects and features of this invention will be understood from the following descriptions in conjunction with embodiments of this invention referring to the annexed drawings.

DETAILED DESCRIPTION OF PREFERRED EMBODIMENTS

Figure 1:
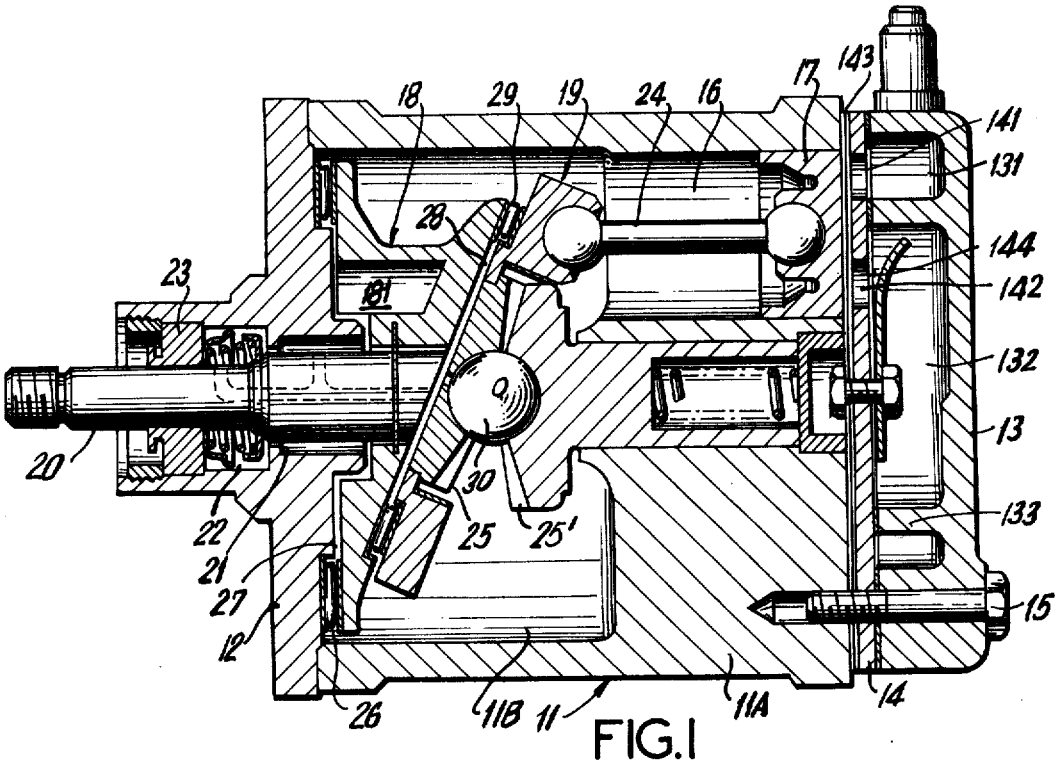
FIG. 1 is a cross sectional view of an embodiment of this invention.

Referring to FIG. 1, there is shown a refrigerant compressor according to this invention, which comprises a housing 11 having a cylinder block 11A at one end thereof and a hollow portion 11B at the other.

The hollow portion 11B mounts a front cover plate 12 by means of screws and the cylinder block 11A mounts a cylinder head 13 and a valve plate 14 by means of bolts 15 to complete a closed housing assembly for the compressor.

Figure 2:
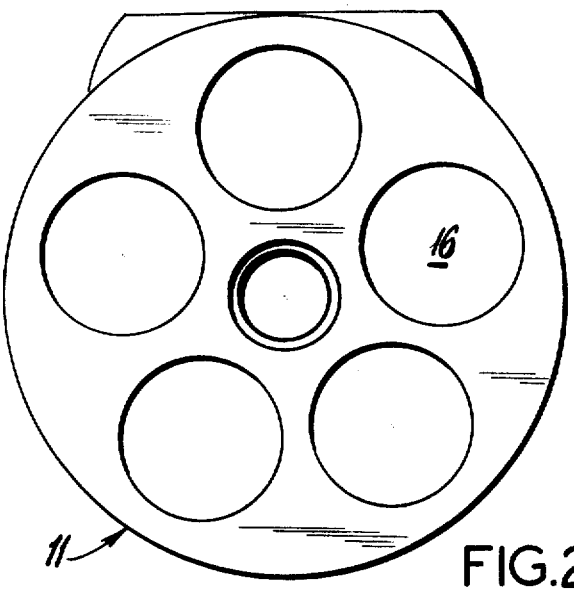
FIG. 2 is an end view of a cylinder block in FIG. 1.

The cylinder block 11A is formed with a plurality of cylinders (five cylinders are shown in FIG. 2) 16, in which pistons 17 are slidably fitted, respectively.

In the hollow portion 11B, a wedge-shaped rotor 18 and a wobble plate 19 are disposed. The rotor 18 is secured on a drive shaft 20 which is borne by a journal bearing 21 in the front cover plate 12, and thus the rotor 18 is rotated by the rotation of the shaft 20.

The front cover plate 12 is formed with a shaft seal cavity 22, in which a shaft seal assembly 23 is mounted to seal the shaft 20 extending in the cavity 22.

The wobble plate 19 is connected with all pistons 17 by connecting rods 24. As disclosed in the above-mentioned U.S. patents, the wobble plate 19 is maintained against rotation in the housing. A pair of intermeshing gear-like elements 25, 25' is shown but the cross-axis mechanism disclosed in U.S. Pat. No. 3,761,202 may be employed.

Thus, by rotation of the shaft 20, all pistons 17 are reciprocated in respective cylinders 16, in the known manner.

Between the rotor 18 and the front cover plate 12, a thrust bearing assembly 26, such as of the roller or needle bearing type, is mounted and a gap 27 is provided thereby about the shaft 20.

A second gap 28 is provided between the rotor 18 and the wobble plate 19 by the provision of a second thrust bearing assembly 29 therebetween.

The cylinder head 13 is formed with a suction chamber 131 and a discharge chamber 132 which are partitioned by a wall 133, as well known in the prior art.

The valve plate 14 is formed with suction and discharge openings 141 and 142 in registry with the suction and discharge chambers 131 and 132, respectively, and in registry with each cylinder 16. The valve plate 14 is provided with a suction reed valve 143 and a discharge reed valve 144 as is known in the prior art.

In operation, the drive shaft 20 is rotated by the motor of the vehicle through power transmitting means. The wedge-shaped rotor 18 is rotated together with the shaft 20 to cause the non-rotatable but wobbling motion of the wobble plate 19, so that pistons 17 are reciprocated in respective cylinders 16 in different phase of reciprocating motion from one another. By the reciprocation of the pistons, refrigerant gas is sucked into, and discharged from the cylinders.

The essential structure and operation of the compressor to shown in the FIGS. 1 and 2 and above-mentioned, are similar as compressors shown in above described U.S. patents. But this embodiment is characterized by the structure which is described hereinafter.

The wobble plate 19 is so formed that a centroid thereof may be on a wobbling center which is on a central axis of the drive shaft 20. The wobbling center is a point about which the wobble plate 19 wobbles, and a center 0 of the ball 30 between gear elements 25 and 25'.

Actually, a centroid of wobbling parts is on the wobbling center, which parts includes the bearing 29, joints with piston rods 24 besides the wobble plate 19.

All of pistons and piston rods 17–24 have equal mass to one another, and are arranged with an equal angular space with respect to one another about the central axis of the drive shaft 20.

The rotor is so formed that a centroid thereof may be on the central axis of the drive shaft 20.

Accordingly, a centroid of the system of the rotor 18, the wobble plate 19, the piston rods 24, and the pistons 17 is on the central axis of the drive shaft. Thus, radial unbalance force, or unbalance centrifugal force, may not be developed in the system when the drive shaft is rotated to operate the system. This results in no radial vibration of the apparatus.

Axial forces may be applied to the system during the reciprocation of pistons 17 and piston rods 24, because of inertia thereof. But because all pistons and piston rods 17–24 are equal in mass to one another and because they are arranged with equal angular space to one another about the central axis of the drive shaft 20, axial forces F and F′ (FIGS. 3*a* and 3*b*) are equal in amplitude to one another but are opposite in direction to one another. These forces are applied to the wobble plate 19 at both sides of an imaginary plane which includes the central axis of the drive shaft and is perpendicular to another plane defined by the central axis and a point on the wobble plate nearest to the cylinder block 11A. This is illustrated in FIG. 3*b*.

Thus, the total sum of the axial forces is also zero which this means that the system is not vibrated in the axial direction.

But these opposite forces F and F′ develop a torque about an axis perpendicular to the central axis of the shaft 20, because of the difference of the application points thereof.

This torque must be cancelled because the torque may cause vibration of the apparatus.

Figure 3A:
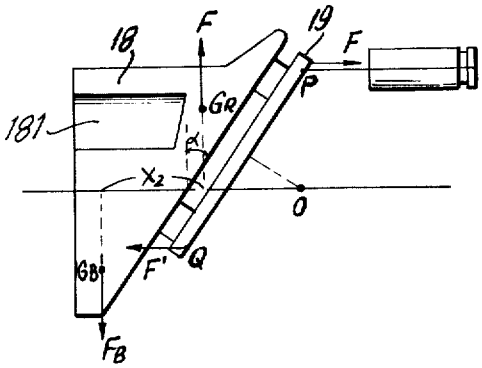
FIG. 3*a* illustrates the relationships of forces developed in an operation system of a rotor, a wobble plate, pistons, and piston rods in FIG. 1.
Figure 3B:
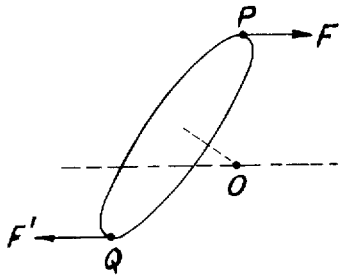
FIG. 3*b* illustrates the relationship of forces applied to a wobble plate in FIG. 1, FIG. 4*a* describes the rotation of the rotor in FIG. 1, FIG. 4*b* describes the wobbling motion of a wobble plate in FIG. 1.

In this embodiment, the rotor 18 is so formed, as shown in FIG. 3*a*, that centroids of two half sections of the rotor split by a plane may be axially spaced by a predetermined distance, which plane includes the central axis of the rotor and is perpendicular to another plane defined by the central axis and a point on the inclined surface of the rotor nearest to the cylinder block 11A. Namely, a centroid $G_R$ of a half section which includes the point nearest to the cylinder block is axially spaced by a distance $x_2$ from the other centroid $G_B$ of the other half section.

Accordingly, during the rotation of the rotor, centrifugal forces $F_R$ and $F_B$ applied to centroids $G_R$ and $G_B$ provide a torque to rotate the rotor 18 about an axis perpendicular to the central axis of the rotor.

The torque due to the centrifugal forces is opposite to the torque due to the inertia of the pistons and piston rods.

Accordingly, if the axial distance $x_2$ between the centroids $G_R$ and $G_B$ is so selected that the torque due to the centrifugal forces may cancel the torque due to the inertia of the pistons and piston rods, any vibration of the apparatus, which generates from the torque due to the reciprocation of pistons and piston rods can be suppressed.

This will be explained referring to FIGS. 3*a*, 4*a* and 4*b*.

Figure 4A:
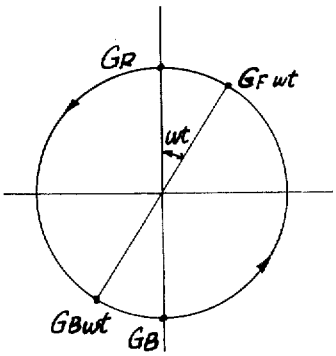
Figure 4B:
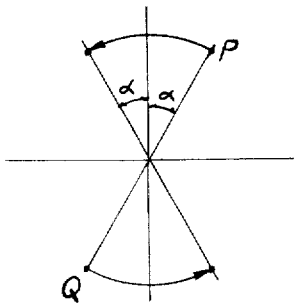

When the rotor 18 is rotated at an angular speed of $\omega$ (rad./sec.) together with the rotation of the drive shaft 20, two points P and Q on the wobble plate 19 reciprocate in the axial direction but in opposite directions to one another, by the wobbling motion of the wobble plate 19 over an angular extent of $2\alpha$, as shown in FIG. 4*b*. $\alpha$ is an inclined angle of the inclined surface of the rotor 18.

The torque $P_1$ due to the reciprocation of pistons 17, is given by the following equations;

$$P_1 \approx \frac{\omega^2}{g}(W_r x)_1 \cos \omega t \text{ (gr. cm)} \quad (1)$$

$$(W_r x)_1 = \frac{\sin \alpha}{2}\left\{N(W_P = W_R)R_0^2 + \frac{\pi}{2} d' \cdot f' \cdot R'^2\right\} \text{(gr. cm}^2\text{)} \quad (2)$$

where, $g$ is acceleration of gravity (cm/sec$^2$), $t$ is an elapsed time from the state shown in FIG. 3*a*, $W_P$ is a weight of a piston (gr.), $W_R$ is a weight of a piston rod, $N$ is a number of cylinders, $R_0$ is a radius of a circle on which the pistons are arranged, and $\pi$ is ratio of the circumference of a circle to its diameter. $d'$, $f'$ and $R'$ are thickness, density and radius of a uniform circular plate equivalent to the wobbling parts.

It should be noted that the axial forces developed during the reciprocation of the pistons are based on the inertia of not only pistons 17 and the piston rods but also the wobbling parts including the wobble plate 19, bearing 29 and other wobbling members.

The rotation of the rotor causes the wobbling motion of the wobble plate 19 over the angular extent of $2\alpha$. At that time, points on the inclined surface of the rotor 18 are shifted at the angular speed of $\omega$ by the rotation of the rotor, which are corresponding to points P and Q on the wobble plate 19.

When $t = 0$, centroids $G_R$ and $G_B$ correspond to points P and Q, respectively, as shown in FIG. 3*a*. After a time $t$ being elapsed, centroids $G_R$ and $G_B$ move an angular extent of $\omega t$ so that centroids of $G_R\omega t$ and $G_B\omega t$, as shown in FIG. 4*a*, may be correspond to the points P and Q, respectively. The axial space between the centroids $G_R\omega t$ and $G_B\omega t$ is $x_2 \cos\omega t$.

Therefore, the torque $P_2$ due to the centrifugal forces by the rotation of the rotor 18 is given by following equation (3), at an angular position corresponding to the points P and Q on the wobble plate;

$$P_2 = -\frac{\omega^2}{g} W_r x_2 \cos \omega t \text{ (gr. cm)} \quad (3)$$

In the equation, $(\omega^2/g)\, W_r$ is a centrifugal force at an optional angular position of the rotor. The negative sign means that the torque $P_2$ is opposite to the torque $P_1$ in direction.

As a result, if the axial distance $x_2$ is selected to fulfill the following equation (4), $$P_1 + P_2 = 0 \quad (4)$$

the torques $P_1$ and $P_2$ cancel out with one another so that vibration of the apparatus may not be generated due to the torque developed by the reciprocation of pistons 17.

It should be noted that rotor 18 is readily formed to have a desired axial distance $x_2$, without the centroid of the rotor departing from the central axis thereof. Namely this is realized by controlling the shape of the hollow portion 181 formed in the rotor 18.

Figure 5A:
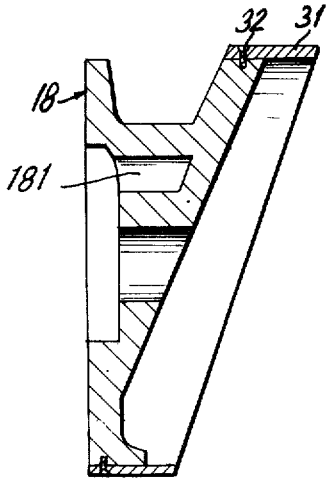
FIG. 5*a* is a cross-sectional view of a modification of a rotor in FIG. 1.
Figure 5B:
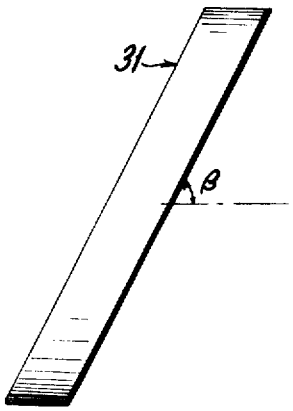
FIG. 5*b* is a side view of a ring member in FIG. 5.

But this is realized without controlling the shape of the hollow portion, by fitting a ring member 31 onto and around the rotor 18, as shown in FIGS. 5*a* and 5*b*.

Referring to FIGS. 5*a* and 5*b*, the ring member 31 is formed to incline by an angle of $\beta$ to the central axis thereof and to have the uniform mass distribution thereof over the entire circumference thereof.

The ring member 31 is fitted onto and around the rotor 18 and removably fixed to the rotor by means of bolts 32, as shown in FIG. 5*a*.

Accordingly, the axial distance $x_2$ may be readily controlled to a required distance, if ring members having various inclining angles are prepared.

Figure 6:
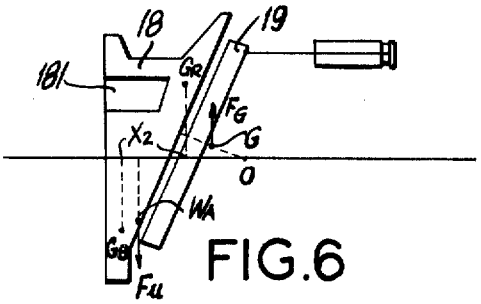
FIG. 6 illustrates the relationships of forces developed in an operation system of a rotor, a wobble plate, pistons, and piston rods in a modification of FIG. 1.

Referring to FIG. 6, in which a modification of the embodiment in FIG. 1 is illustrated, the wobble plate 19 is so formed that the centroid G thereof may depart from the wobbling center 0 and may be on a perpendicular drawn from the wobbling center 0 to the inclined surface of the rotor 18. The rotor 18 has an unbalanced weight $W_A$ at an angular position spaced by 180° from the angular position of the centroid G of the wobble plate 19.

In the operation of the compressor of FIG. 6, when the wobble plate 19 wobbles about the wobbling center 0 by the rotation of the rotor 18, the centroid G may rotate about the center axis of the rotor 18 so that an unbalanced centrifugal force $F_G$ may develop. But the unbalanced centrifugal force $F_G$ may be cancelled by another centrifugal force $F_U$ developed by the rotation of the unbalanced weight $W_A$ together with the rotor 18, if the unbalanced weight is so selected that the force $F_U$ is equal to the other force $F_G$ in the strength.

Therefore, the system of the rotor, the wobble plate, pistons and piston rods is still maintained in the balanced state, similarly as in the embodiment in FIG. 1.

On the other hand, the two centrifugal forces $F_G$ and $F_U$ are axially spaced in the application point thereof, so that these two forces $F_G$ and $F_U$ develop a torque $P_3$.

The torque $P_3$ is opposite to the torque $P_1$ due to the reciprocation of pistons 17 in the direction. Therefore, the torque $P_1$ is partially cancelled by the torque $P_3$.

The remaining torque $P_1 + P_3$ may be cancelled by the torque $P_2$ developed by the fact that centroids $G_R$ and $G_B$ are axially spaced to one another by a predetermined distance $x_2$, which are centroids of the two half sections of the rotor 18 split by the imaginary plane similarly as described in connection with FIG. 3*a*.

In this modification, the strength of the torque which should be cancelled by the torque $P_2$ is smaller than that in the embodiment of FIG. 1 by $P_3$ so that the strength of the torque $P_2$ is smaller than in the embodiment in FIG. 1. This means that the distance $x_2$ can be selected to be shorter than in the embodiment of FIG. 1. Accordingly, the axial length of the rotor 18 may be shortened in this modification and, therefore, a reduction of axial length of the compressor may be achieved.

It is realized by the designation of the hollow portion 181 formed in the rotor 18 to provide the unbalance weight $W_A$ to the rotor. Alternatively, this may be realized by adding a weight member to the rotor 18, after the balanced rotor is formed.

Figure 7:
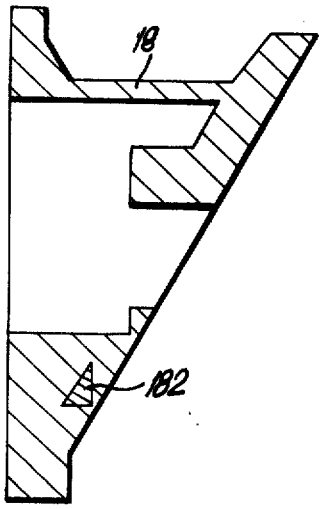
FIG. 7 is a cross-sectional view of a rotor used in the modification in FIG. 6.

For example, as shown in FIG. 7, a weight member 182 may be cast into the rotor 18, which member is of a material having a greater density than that of the rotor material. For example, the rotor 18 may be of aluminum and the weight member 182 may be of iron.

To control the axial distance $x_2$ of centroids $G_R$ and $G_B$, a ring member 31 such as that shown in FIGS. 4*a* and 4*b*, may be also provided to the rotor 18 of FIG. 7.

As has been stated above, this invention provides a fluid suction and discharge apparatus of a type in which pistons are reciprocated in respective cylinders by the wobbling motion of a wobble plate driven by the rotation of a wedge-shaped rotor, which apparatus is so formed not only that any unbalance force is not developed in either the radial direction or the axial direction, but also that any torque developed by the reciprocation of pistons may be cancelled, whereby vibration of the apparatus may be considerably reduced.

What we claim is:

1. In a fluid suction and discharge apparatus comprising a generally cylindrical housing, a cylinder block mounted in and at one end portion of said housing, said block having a plurality of axially directed cylinders formed therein in equally spaced annular relation, a plurality of pistons slidably fitted in said cylinders respectively, a plurality of piston rods connected to said pistons respectively, an end plate mounted on the other end of said housing and closing said other end thereof, a drive shaft rotatably borne in said end plate and extending from exterior to interior of said housing through said end plate, said drive shaft extending on an axis which extends on a mid point of a plurality of cylinders formed in spaced annular relation, a wedge-shaped rotor member mounted and fixed on an inner end portion of said drive shaft to be rotated together with said drive shaft within said housing, said wedge-shaped rotor being formed with an end surface inclined to said drive shaft by a predetermined angle at an end thereof opposite to the other end facing to said end plate, wobble means closely mounted, and relatively rotatably borne, on said inclined end surface of said rotor, means for supporting said wobble means at its position and permitting a wobbling motion of said wobble means about a point on said axis, and means for connecting said plurality of piston rods to said wobble means at angularly spaced positions thereon corresponding to said piston rods respectively, whereby said pistons are reciprocated within respective cylinders in different phase of reciprocating motion from one another by the rotation of said drive shaft to perform fluid suction and discharge, the improvement which comprises: said wobble means being formed such that a centroid thereof is on said point about which said wobble means wobbles, said rotor being so formed such that a centroid thereof is on said axis and centroids of two half sections of said rotor split by an imaginary plane and including said axis and perpendicular to a plane defined by said axis and a point on said inclined surface nearest to said cylinder block are axially spaced by a predetermined distance, said distance being so determined such that a torque due to centrifugal forces developed to said rotor during the rotation of said rotor cancels a torque due to the inertia of said pistons, said piston rods, and said wobble means during the reciprocation thereof.

2. The apparatus as claimed in claim 1, wherein said wedge-shaped rotor is rotatably borne on said end plate by means of a thrust bearing, said rotor having a hollow formed therein which is open at an end thereof facing to said end plate to consist the centroid of said rotor with a central axis of said drive shaft and to provide said predetermined axial distance between centroids of said two half sections of said rotor.

3. The apparatus as claimed in claim 1, wherein said rotor is provided with a ring member fitted onto and fixed around said rotor, said ring member being so formed that a centroid thereof is on a center of the ring and that said ring member is inclined to said drive shaft whereby an axial distance between centroids of said two half sections of said rotors is controlled to said predetermined distance.

4. The apparatus as claimed in claim 1, wherein said centroid of said wobble means is on a perpendicular drawn from said point about which said wobble means wobbles to said inclined surface of said rotor, said rotor being provided with an unbalanced weight at an angular position thereof spaced from the angular position of said centroid of said wobble means about an axis of said drive shaft, whereby a centrifugal force developed by the rotation of said centroid of said wobble means about said axis is cancelled with a centrifugal force due to said unbalanced weight during the rotation of said rotor, and said rotor being so formed such that an axial distance between centroids of said two half sections of said rotor is defined to develop a torque due to centrifugal forces during rotation of said rotor which cancel together with a torque due to said centroid of said wobble means and said unbalanced weight, said torque due to the inertia of said pistons, said piston rods, and said wobble means during the reciprocation thereof.

5. The apparatus as claimed in claim 4, wherein said wedge-shaped rotor is rotatably borne on said end plate by means of a thrust bearing, said rotor having a hollow formed therein which is open at an end thereof facing to said end plate to provide said unbalanced weight and said axial distance between centroids of said two half sections of said rotor.

6. The apparatus as claimed in claim 4, wherein, a weight member is attached to said rotor to provide said unbalanced weight to said rotor.

7. The apparatus as claimed in claim 6, in which said rotor is formed of aluminum, an iron weight member being cast in the aluminum rotor to provide said unbalanced weight to said rotor.

* * * * *